US010441061B2

(12) United States Patent
Wang

(10) Patent No.: US 10,441,061 B2
(45) Date of Patent: Oct. 15, 2019

(54) MULTIFUNCTIONAL PICNIC BOX

(71) Applicant: SUZHOU SKY INDUSTRIAL CO., LTD., Jiangsu (CN)

(72) Inventor: Tiankun Wang, Jiangsu (CN)

(73) Assignee: SUZHOU SKY INDUSTRIAL CO., LTD., Jiangsu (CN)

( * ) Notice: Subject to any disclaimer, the term of this patent is extended or adjusted under 35 U.S.C. 154(b) by 0 days.

(21) Appl. No.: 15/756,022

(22) PCT Filed: Aug. 18, 2016

(86) PCT No.: PCT/CN2016/095833

§ 371 (c)(1),
(2) Date: Feb. 27, 2018

(87) PCT Pub. No.: WO2018/006476

PCT Pub. Date: Jan. 11, 2018

(65) Prior Publication Data

US 2018/0255911 A1 Sep. 13, 2018

(30) Foreign Application Priority Data

Jul. 8, 2016 (CN) ..... 2016 1 0534693

(51) Int. Cl.

| | |
|---|---|
| ***A45F 3/46*** | (2006.01) |
| ***A45C 11/20*** | (2006.01) |
| ***A45C 13/02*** | (2006.01) |

(52) U.S. Cl.

CPC ..... *A45F 3/46* (2013.01); *A45C 11/20* (2013.01); *A45C 13/02* (2013.01); *A45C 2013/026* (2013.01)

(58) Field of Classification Search

CPC ..... A45C 9/00; A45C 11/20; A45C 13/02; A45C 2013/026; A45F 3/46; A47B 3/10; A47B 3/087; A47B 87/002

(Continued)

(56) References Cited

U.S. PATENT DOCUMENTS

| | | | |
|---|---|---|---|
| 244,898 | A | 7/1881 | Hoskins |
| 1,590,586 | A | 6/1926 | McDonald |

(Continued)

FOREIGN PATENT DOCUMENTS

| | | | |
|---|---|---|---|
| CN | 201101239 | Y | 8/2008 |
| CN | 201235840 | Y | 5/2009 |

(Continued)

OTHER PUBLICATIONS

ISA/CN, International Search Report dated Apr. 11, 2017 in International Application No. PCT/CN2016/095833, total 4 pages with English translation.

(Continued)

*Primary Examiner* — Bryon P Gehman
(74) *Attorney, Agent, or Firm* — Masuvalley & Partners

(57) ABSTRACT

The invention relates to a multifunctional picnic box that includes a box body. The box body as described above has a cover which can be opened. At upper end in the box body as described above, there is at least a group of folding table with corresponding size of box body as described above. In the box body under the folding table as described above, it sets support for placing picnic appliance. It is able to take folding table, some simple cooking utensils in the box.

1 Claim, 6 Drawing Sheets

(58) Field of Classification Search
USPC ..... 206/541–549
See application file for complete search history.

(56) References Cited

U.S. PATENT DOCUMENTS

| | | | | | |
|---|---|---|---|---|---|
| 2,603,500 | A * | 7/1952 | Messier | A47B 31/00 | 206/546 |
| 3,989,128 | A * | 11/1976 | Walker | A45C 5/143 | 190/18 A |
| 4,131,327 | A * | 12/1978 | Marshall | A47B 3/10 | 312/241 |
| 4,195,889 | A * | 4/1980 | Coyne | A47B 3/10 | 190/12 R |
| 5,431,298 | A * | 7/1995 | Ahn | A45C 9/00 | 206/45.2 |
| 6,173,839 | B1 * | 1/2001 | Dieter | A45C 3/001 | 206/542 |
| 9,433,270 | B2 * | 9/2016 | D'Angelo | A45C 5/146 | |
| 2014/0262660 | A1 | 9/2014 | D'Angelo | | |

FOREIGN PATENT DOCUMENTS

| | | | |
|---|---|---|---|
| CN | 201319933 | Y | 10/2009 |
| CN | 203407704 | U | 1/2014 |
| CN | 204015504 | U | 12/2014 |
| CN | 204345505 | U | 5/2015 |
| CN | 204838378 | U | 12/2015 |
| CN | 205026739 | U | 2/2016 |
| DE | 202005011223 | U1 | 10/2005 |
| DE | 202015106739 | U1 | 4/2016 |
| JP | S50-1 | Y1 | 1/1975 |
| JP | H09-173125 | A | 7/1997 |

OTHER PUBLICATIONS

SIPO, The first notice of office action dated Jun. 28, 2017 in corresponding Chinese Patent Application No. 201610534693.1, total 17 pages with English translation.

EPO, Extended European Search Report dated Feb. 11, 2019 in EP Patent Application No. 16907980.3, 9 pages.

Canadian Intellectual Property Office, Office Action dated Oct. 24, 2018 in CA Patent Application No. 2,991,932, 5 pages.

IP Australia, Examination report No. 1 dated Feb. 22, 2019 in AU Patent Application No. 2016413850, 4 pages.

CNIPA, 3rd Office Action dated Oct. 9, 2018 in CN Patent Application No. 201610534693.1, 22 pages with English translation.

* cited by examiner

MULTIFUNCTIONAL PICNIC BOX

RELATED APPLICATIONS

This application is a U.S. National Phase application under 35 U.S.C. § 371 of International Patent Application No. PCT/CN2016/095833 filed Aug. 18, 2016, which claims priority to Chinese Patent Application No. 201610534693.1 filed Jul. 8, 2016; which are hereby expressly incorporated by reference in their entirety for all purposes.

TECHNICAL FIELD

The invention relates to a multifunctional picnic box which belongs to the technical field of picnic appliance.

DESCRIPTION OF RELATED ART

Picnic is a kind of leisure and entertainment activity for the people who are fond of travel and play. For picnic, people need to bring various articles in order to meet the demand. Thus, picnic box becomes more and more popular for people. At present, there are various picnic boxes. However, it is found that the existing picnic boxes still have many shortcomings through long-term use.

For example, a patent for utility model under China patent license announcement number CN203369806U publicized a kind of picnic appliance on the date of authorization proclamation of Jan. 1, 2014. More specifically, it involves with a kind of multifunctional picnic box, including the box body and a box cover outside the box. The box body as described above is assembled by barbecue oven, charcoal-making box, and hot pot equipment which is placed between the barbecue oven and charcoal-making box; there is pull-out No. 1 charcoal box in the barbecue oven as described above; there is pull-out No. 2 charcoal box at the bottom of the charcoal-making box, the cavity above the No. 2 charcoal box is combustion chamber, charcoal leaking net is set between the combustion chamber and No. 2 charcoal box; it sets an opening for adding woods on one side wall of combustion chamber, and sets a ventilation opening on the other side wall; the hot pot equipment as described above includes pot body and the support plate which is fixed on the edge of the pot. The advantages of the utility model are: it not only can be used for barbeque, but also has the function of hot pot and cooking fried food; people can use local materials outdoor and make charcoal by wood so as to reduce the burden and expense of travel; easy to carry. However, for above mentioned picnic box, the internal space use of the box body is not reasonable; in the meantime, it has the defect and problem of single function of box body.

CONTENTS OF THE INVENTION

The invention shall solve the technical problem for providing a multifunctional picnic box with simple structure and strong function which is able to carry folding table, some simple cooking utensils in the box.

In order to solve above mentioned technical problem, the invention adopts the technical solution as below:

A multifunctional picnic box, including the box body; the box body as described above has a cover which can be opened; at upper end in the box body as described above, there is at least a group of folding table with corresponding size of box body as described above; in the box body under the folding table as described above, it sets support for placing picnic appliance.

The features of a multifunctional picnic box as mentioned above are described as below: it sets support ring at the upper end of internal surface in the box body and along the line; the folding table as described above is placed on the support ring as described above.

The features of a multifunctional picnic box as mentioned above are described as below: the panel base settings at both sides of folding table after unfolding are used for containing the first groove of support legs; meanwhile, the two support legs of the same first groove form diagonal shape setting. The length of support legs is adjustable.

The features of a multifunctional picnic box as mentioned above are described as below: it sets two groups of folding tables in the box body; and sets at least a hook on the end face of both sides of the panel of each group of folding table. The hook on one of the folding tables is U-shaped, while the hook of the other folding table is reversed U-shaped. Furthermore, one side of end face of the hook is fixed on the panel of folding table; and the height of the other side of end face is half of its slot height, while its width is as same as its slot width.

The features of a multifunctional picnic box as mentioned above are described as below: it sets ultraviolet germicidal lamp on the lower surface of support ring as described above.

The features of a multifunctional picnic box as mentioned above are described as below: it sets temperature sensor and humidity sensor in the box body as described above. On the surface of the box body as described above, it sets LCD panel which is electrical connected to the mentioned temperature sensor and humidity sensor for displaying the temperature and humidity in the box body.

The features of a multifunctional picnic box as mentioned above are described as below: it sets telescopic pull rod on the box body as described above.

The features of a multifunctional picnic box as mentioned above are described as below: it sets two elastic rotation shafts symmetrically at the bottom end of the undersurface of box body. The mentioned elastic rotation shafts connect to support plate. On the mentioned support plate, there is fixed connection of truckle. The second groove is set on the bottom surface of box body for containing the mentioned elastic rotation shafts, support plate, and truckle. On the bottom surface of the box body, it also sets two pins which could move relatively for limiting the support plate. The mentioned two pins are connected through linked rod. At the center of the mentioned linked rod, it connects to the connecting rod which extends to the bottom of the box body. On the bottom of the box body as described above, it sets button for pushing the connecting rod.

The features of a multifunctional picnic box as mentioned above are described as below: there are pot, bowls, chopsticks, folding table lamp, kettle, stove and other picnic appliance in the box body under the folding table as described above. It sets windproof fence on the upper surface edge of the mentioned stove.

The features of a multifunctional picnic box as mentioned above are described as below: the folding table lamp as described above includes lampshade and support plate with assembled modulator tube. One side of the support plate as described above is connected rotationally to the mentioned lampshade. The other side is connected rotationally to the portable power source with electrical connection of mentioned modulator tube; meanwhile, the third groove is set on the support plate as described above; the mentioned portable power source could be contained in the third groove as described above completely after rotation. It sets arc groove on the internal surface of the side with the connection of lampshade and support plate.

The beneficial effects of the invention are listed as below:

1. Through placing the folding table in the box body, the picnic box is portable; in the meantime, the table size can be increased through jointing the folding table;

2. Through setting ultraviolet germicidal lamp in the box body, it is easy to disinfect the tableware in the box body;

3. Through setting temperature sensor and humidity sensor in the box body, it is easy to display the temperature and humidity in the box body in real time;

4. Through setting hidden truckle at the bottom of box body, it can be unfolded or folded by demands;

5. Through setting folding table lamp in the box body, it can be folded with little space occupation and easy to carry; meanwhile, it is powered by external and containable portable power source, which is safe and convenient.

DETAILED DESCRIPTION

Figure 1:
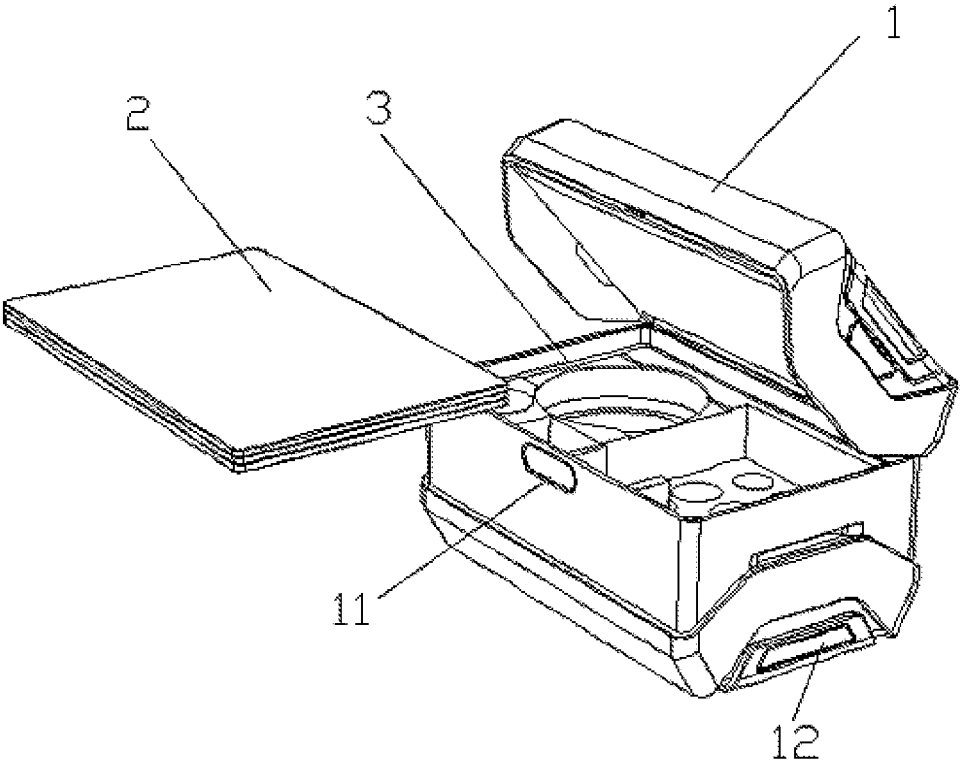
FIG. 1 is the structure diagram of the invention, i.e. a multifunctional picnic box.
Figure 2:
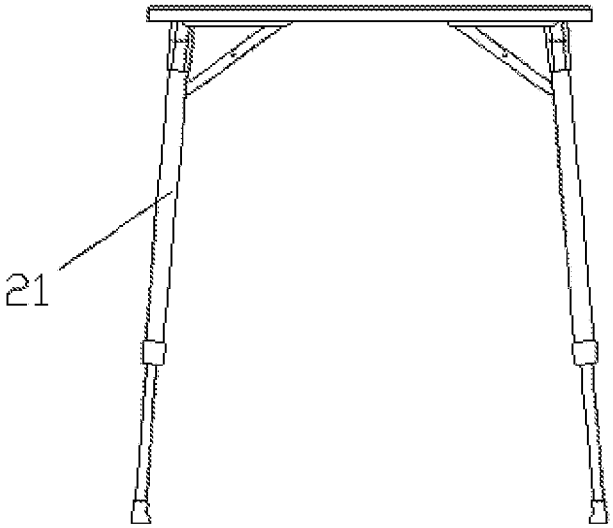
FIG. 2 is the side view of the folding table of the invention after unfolding.
Figure 3:
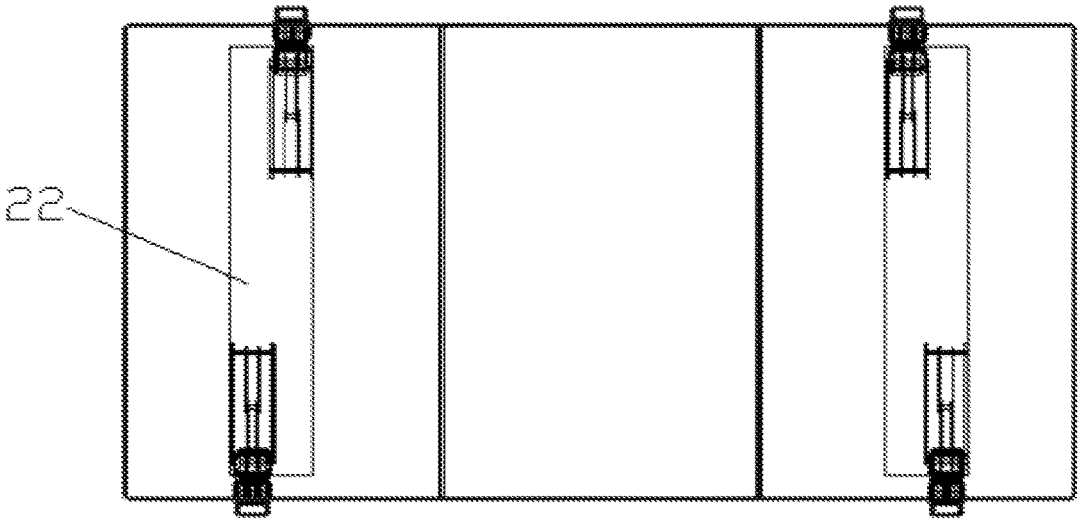
FIG. 3 is the upward view of the folding table of the invention after unfolding.
Figure 4:
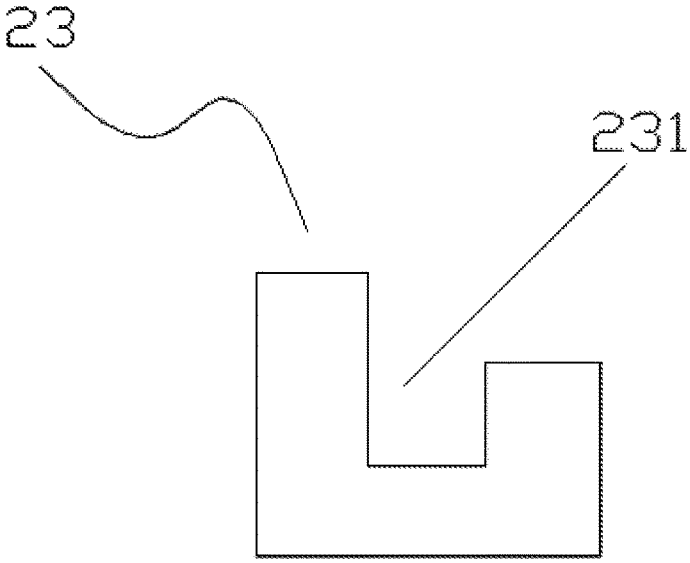
FIG. 4 is the structure diagram of the hook of the invention.

In the following text, it makes further explanation of the invention in the combination of the attached figures of the instruction manual.

As showed in FIG. 1-FIG. 11, a multifunctional picnic box, including the box body 1. The box body 1 as described above has a cover which is able to open. At upper end in the box body 1 as described above, there is at least a group of folding table 2 with corresponding size of box body 1 as described above. In the box body under the folding table 2 as described above, it sets support for placing picnic appliance. After folding the folding table 2, it can be put in the box body and assembled on the internal surface of the box body, which is portable and easy for transportation. In the implementation example, it sets support ring 3 at the upper end of internal surface in the box body 1 and along the line; the folding table 2 as described above is placed on the support ring 3 as described above, which is convenient for taking and fixing. In the meantime, it sets ultraviolet germicidal lamp on the lower surface of support ring 3 as described above. It not only disinfects the tableware in the box body 1 well, but also hides the ultraviolet germicidal lamp in the support ring 3, which has smart structure and nice appearance.

The panel base settings at both sides of folding table 2 after unfolding are used for containing the first groove 22 of support legs 21; meanwhile, the two support legs 21 of the same first groove 22 form diagonal shape setting. When folding the support legs 21, they are parallel and contained in the first grove 22. Thus, the length design of support legs 21 can be relatively longer; meanwhile, the length of support legs 21 is adjustable. It further improves the height of folding table after unfolding.

Figure 5:
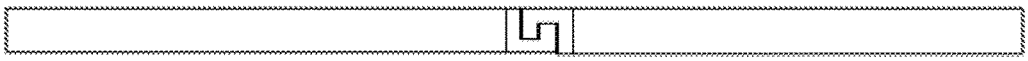
FIG. 5 is the structure diagram of two folding tables of the invention after putting together.
Figure 6:
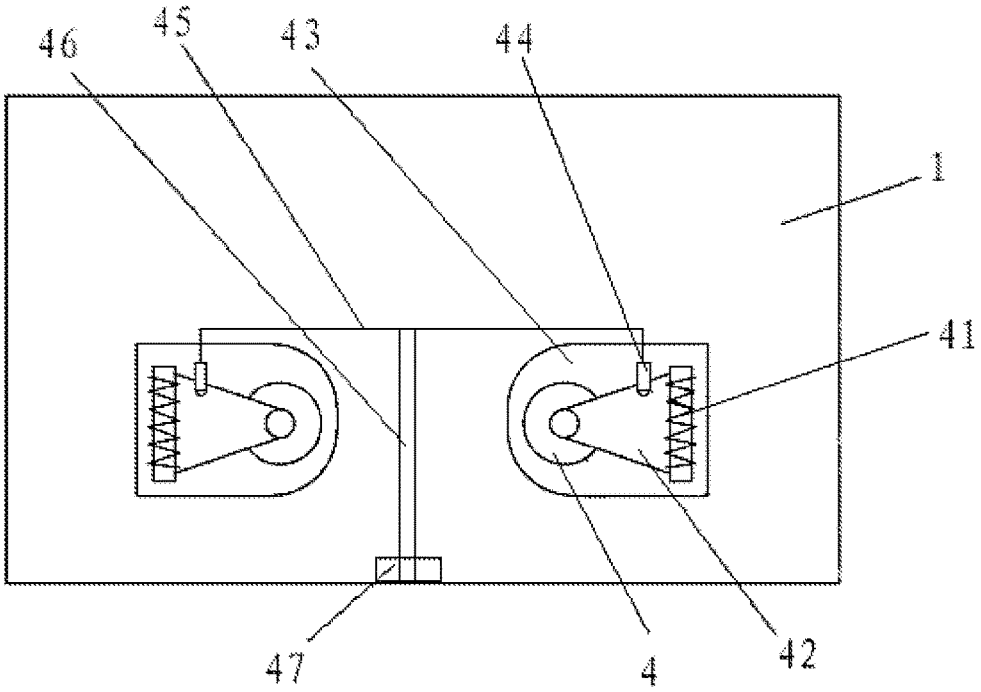
FIG. 6 is the structure diagram of the truckle of the invention at the bottom of the box body after folding.
Figure 7:
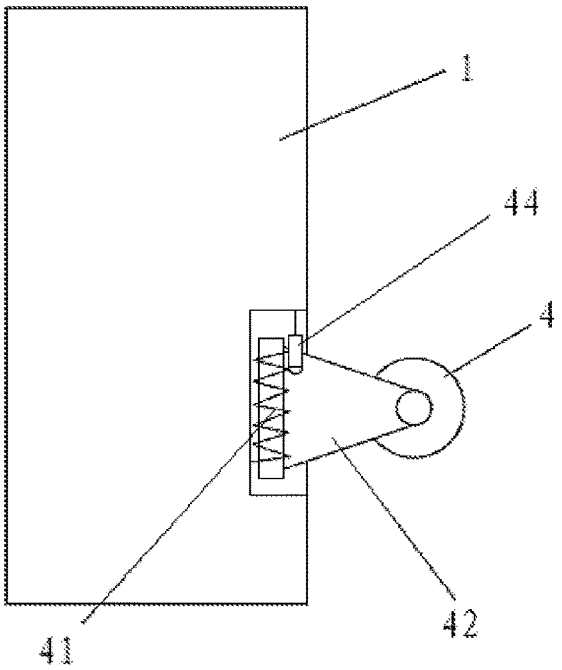
FIG. 7 is the structure diagram of the truckle of the invention at the bottom of the box body after unfolding.
Figure 8:
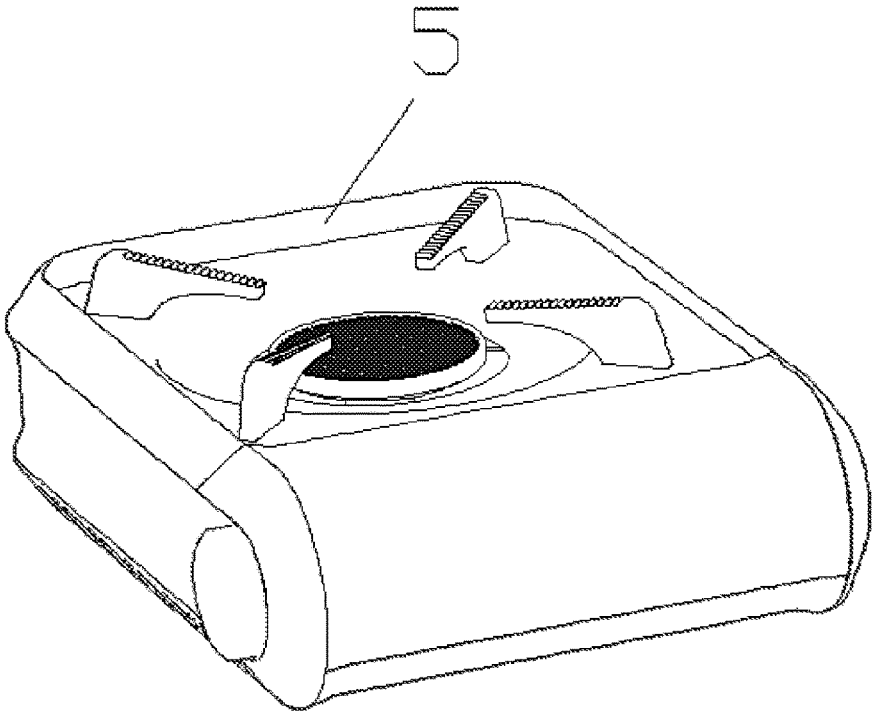
FIG. 8 is the structure diagram of the stove of the invention.
Figure 9:
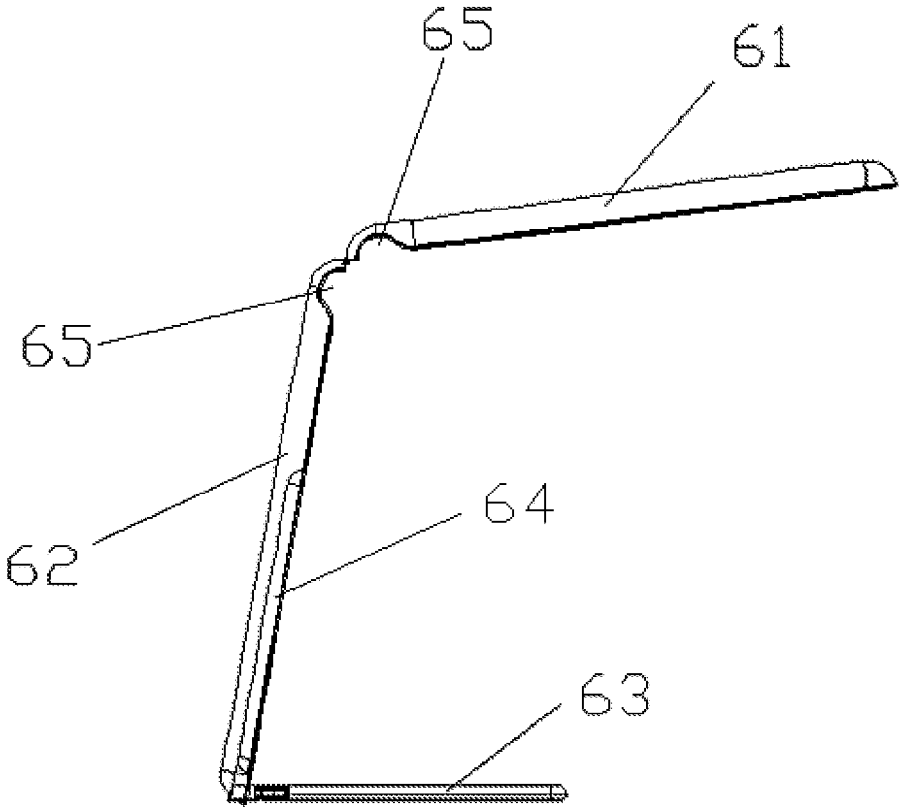
FIG. 9 is the structure diagram of the folding table lamp of the invention after unfolding.
Figure 10:
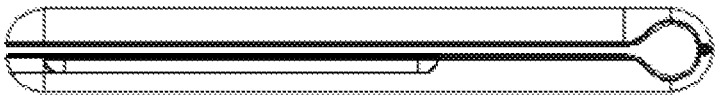
FIG. 10 is the structure diagram of the folding table lamp of the invention after folding.
Figure 11:
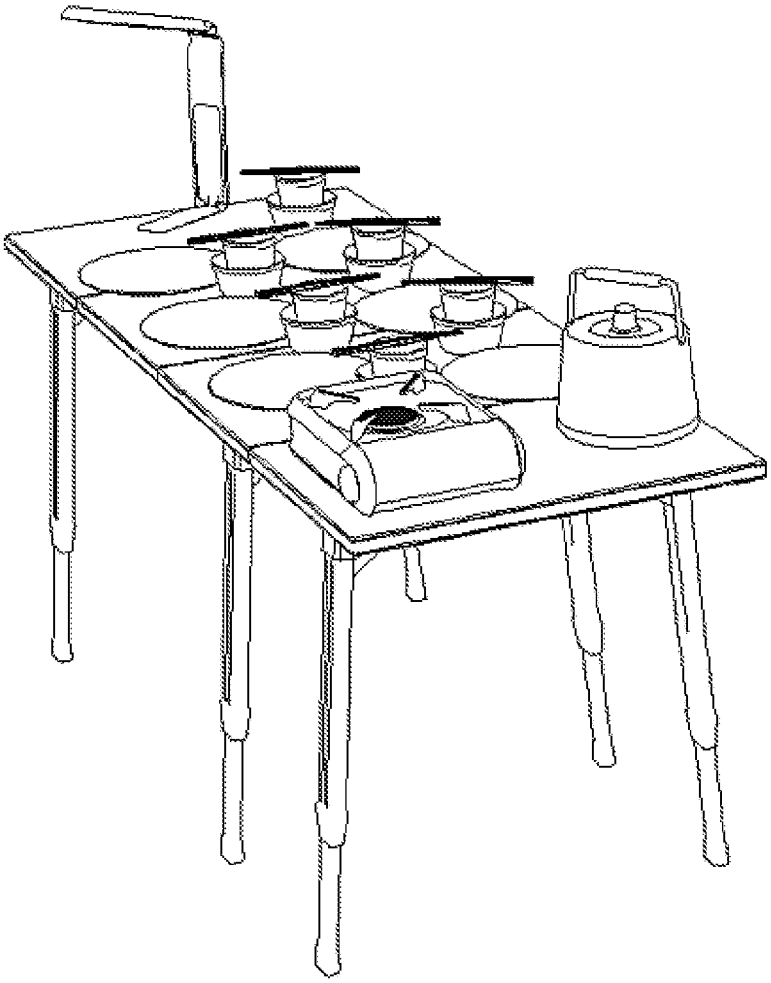
FIG. 11 is the structure diagram of the display of articles in the box body for the invention, i.e. a kind of multifunctional picnic box.

It sets two groups of folding tables 2 in the box body 1; and sets at least a hook 23 on the end face of both sides of the panel of each group of folding table 2. The hook on one of the folding tables is U-shaped, while the hook of the other folding table is reversed U-shaped. Furthermore, one side of end face of the hook is fixed on the panel of folding table 2; and the height of the other side of end face is half of its slot height, while its width is as same as its slot width. FIG. 5 shows the structure of the two folding tables after unfolding and two panels after putting together. It forms primary and secondary snap fasteners at the joint. It has stable connection and consistent height of table after connection. In the implementation example, considering the thickness of the two tables after folding, one of the folding tables is composed by three panels for placing tableware, table lamp and other articles. The other folding table is composed by a single panel for placing some cookware.

It sets temperature sensor and humidity sensor in the box body 1 as described above. On the surface of the box body 1 as described above, it sets LCD panel 11 which is electrical connected to the mentioned temperature sensor and humidity sensor for displaying the temperature and humidity in the box body in real time.

It sets two elastic rotation shafts 41 symmetrically at the bottom end of the undersurface of box body 1. The mentioned elastic rotation shafts 41 connect to support plate 42. On the mentioned support plate 42, there is fixed connection of truckle 4. The second groove 43 is set on the bottom surface of box body 1 as described above for containing the mentioned elastic rotation shafts 41, support plate 42, and truckle 4. On the bottom surface of the box body 1, it also sets two pins 44 which could move relatively for limiting the support plate 42. The mentioned two pins 44 are connected through linked rod 45. At the center of the mentioned linked rod 45, it connects to the connecting rod 46 which extends to the bottom of the box body 1. On the bottom of the box body 1 as described above, it sets button 47 for pushing the connecting rod 46. When it needs to unfold the truckle 4, the user shall press the button 47 so as to push pins 44 for cancelling the position limitation of support plate 42, and opening the support plate automatically under the function of elastic rotation shafts 41. On the box body 1 as described above, it also sets telescopic pull rod 12 for pulling the box body.

There are pot, bowls, chopsticks, folding table lamp, kettle, stove and other picnic appliance in the box body under the folding table 2 as described above. It sets windproof fence 5 on the upper surface edge of the mentioned stove.

The folding table lamp includes lampshade 61 and support plate 62 with assembled modulator tube. One side of the support plate 62 as described above is connected rotationally to the mentioned lampshade 61. The other side is connected rotationally to the portable power source 63 with electrical connection of mentioned modulator tube; meanwhile, the third groove 64 is set on the support plate 62 as described above; the mentioned portable power source 63 could be contained in the third groove 64 as described above completely after rotation. It sets arc groove 65 on the internal surface of the side with the connection of lampshade 61 and support plate 62. It can be folded with little space occupation and easy to carry; meanwhile, it is powered by external and containable portable power source, which is safe and convenient.

In conclusion, the invention provides a kind of multifunctional picnic box which can bring folding table, some simple stoves and cookers in the box. It has simple structure and strong function.

The above content displays and describes fundamental principle, key features and advantages of the invention. The technician of the industry shall know that the invention is not limited to the implementation example as mentioned above. The above implementation examples and description in the instruction manual only explain the principle of the invention. On the premise of not breaking away from the spirit and scope of the invention, the invention also has various changes and improvements. These changes and improvements shall be included in the required protective scope of the invention. The required protective scope of the invention is defined by the attached patent claims and its equivalents.

The invention claimed is:

1. A multifunctional picnic box, comprising:

a box body, the box body including a cover that can be opened;

where at an upper end of the box body there is a folding table and under the folding table is a support for placing a picnic appliance; and where the multifunctional picnic box includes two folding tables in the box body and a hook fixed on one side on an end face of a panel of each folding table, each end face facing the other end face;

where the hook on one of the folding tables is U-shaped defining a slot, while the hook of the other folding table is reverse U-shaped also defining a slot; and a height of another side of each hook opposing its one side is half of its slot's height, while the width of each another side is the same as the slot's width.

* * * * *